United States Patent [19]

Sether

[11] 3,978,638

[45] Sept. 7, 1976

[54] PACKAGE CONSTRUCTION OF ARTICLES WITH SHRINK FILM

[75] Inventor: Walter H. Sether, Fairport, N.Y.

[73] Assignee: Mobil Oil Corporation, New York, N.Y.

[22] Filed: May 7, 1974

[21] Appl. No.: 467,759

Related U.S. Application Data

[63] Continuation of Ser. Nos. 65,562, Aug. 20, 1970, abandoned, and Ser. No. 280,020, Aug. 11, 1972, abandoned.

[52] U.S. Cl. ..... 53/30 S

[51] Int. Cl.[2] ..... B65B 43/04; B65B 53/02

[58] Field of Search ..... 53/30, 184 S, 33, 24, 53/39, 392; 206/386; 229/57, 61

[56] References Cited

UNITED STATES PATENTS

| | | | |
|---|---|---|---|
| 2,757,500 | 8/1956 | Heinl et al. | 53/392 X |
| 3,392,504 | 7/1968 | Vates | 53/30 X |
| 3,508,375 | 4/1970 | Myers | 53/30 |
| 3,522,688 | 8/1970 | Kaliwoda et al. | 53/30 |
| 3,618,478 | 11/1971 | Piazze | 229/57 X |
| 3,638,790 | 2/1972 | Schmid et al. | 206/386 X |

OTHER PUBLICATIONS

"A Discussion of Shrink Polyethylene Pallet Covers", by John M. Bills of Cadillac Products, Inc., a Paper Dated Oct. 20, 1969.

*Primary Examiner*—Travis S. McGehee
*Assistant Examiner*—Horace M. Culver
*Attorney, Agent, or Firm*—Charles A. Huggett; James D. Tierney

[57] ABSTRACT

The present invention relates to a method for shrink packaging relatively large objects such as, for example, a pallet load utilizing heat shrinkable thermoplastic structures. The thermoplastic bags are characterized by having a rectangular bottom configuration whereby when the bag structure is shrunk about the generally rectangular pallet load, the contour of the shrunken thermoplastic overwrapped material conforms substantially to the rectangular conformation of the pallet being overwrapped.

2 Claims, 14 Drawing Figures

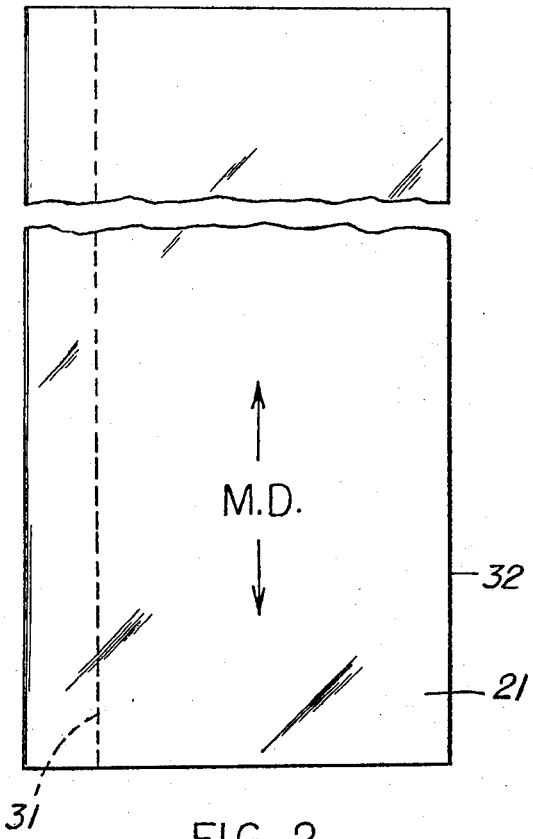
FIG. 2
FIG. 3
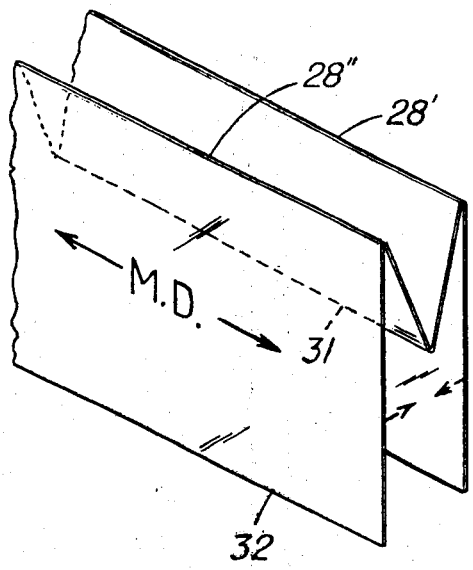
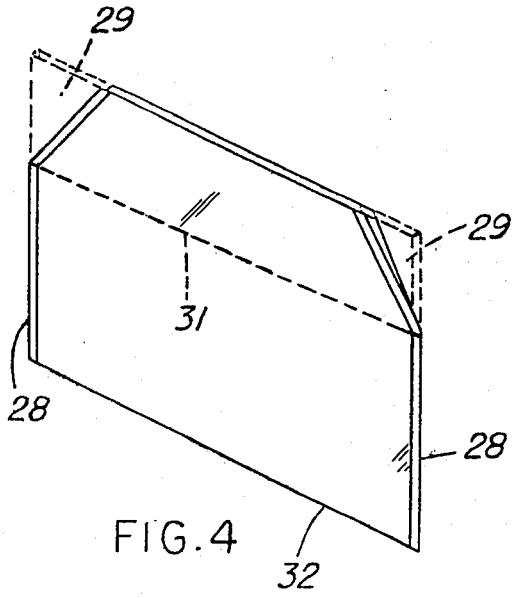
FIG. 4
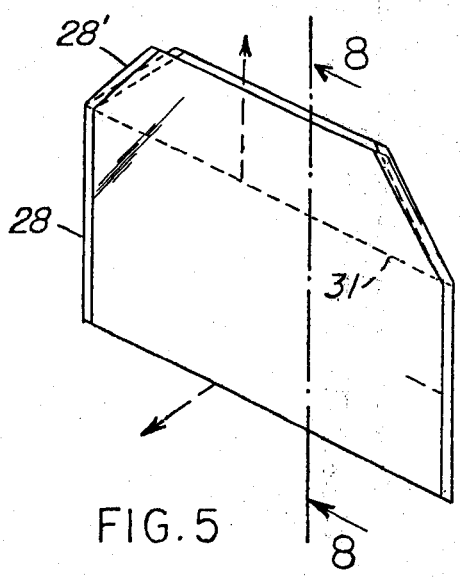
FIG. 5

PRIOR ART
FIG. 10A
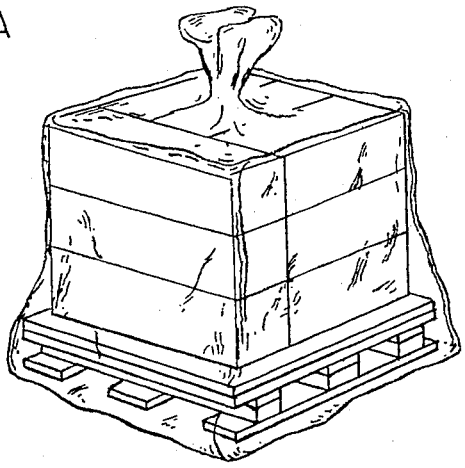
FIG. 10B
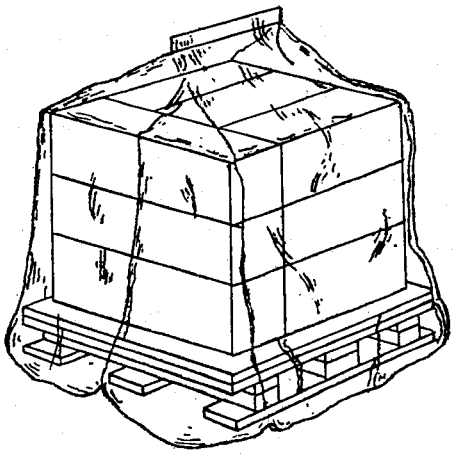
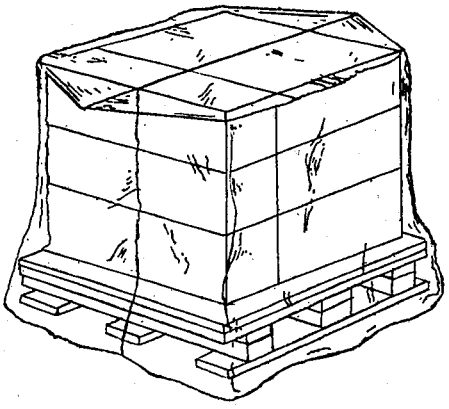
FIG. 10C

PACKAGE CONSTRUCTION OF ARTICLES WITH SHRINK FILM

This application is a continuation of applications Ser. Nos. 65,562 and 280,020 filed respectively Aug. 20, 1970 and Aug. 11, 1972, both of which are now abandoned.

BACKGROUND OF THE INVENTION

1. Field of the Invention

The present invention relates to a method for wrapping pallet loads of goods utilizing heat shrinkable thermoplastic film. Applicants have developed a pallet wrapping system whereby specifically designed individual bags, which have been formed from film stock material which has been highly oriented in a direction which corresponds to the width of the bag in its final form, may be employed to shrink wrap palletized loads. Additionally, it has been found when such bags are constructed in a side-seal, bottom-gusseted, configuration the bag bottom may be easily modified so that when the bag is fitted over the palletized load, the bag bottom which comes into direct contact with the top of the load assumes a generally rectangular configuration, corresponding to the rectangular configuration of the top of the pallet load. Such an arrangement allows the thermoplastic shrouded pallet, when subjected to heat, (a) to shrink in a greater extent around the girth of the pallet by virtue of the higher degree of orientation of the film across the bag width and (b) to generally uniformly conform the rectangular bag bottom with the rectangular top of the pallet load.

2. Description of the Prior Art

In the past a wide variety of heat shrinkable thermoplastic sheet configurations, including bag structures, have been employed to shrink wrap palletized loads of goods. Thermoplastic bags, fabricated from continuous tubes of thermoplastic such as polyethylene, may be used for such shrink-wrap operations. For example, in the past, pallet loads have been enshrouded with plain bottom seal, ungusseted bags and the combination exposed to heat to shrink the bag about the pallet load (see FIG. 10C of the attached drawings). Such an arrangement results in unsightly ears of thermoplastic material projecting from opposite ends of the top of the pallet load. As illustrated in FIG. 10B of the attached drawings, other prior art bag structures employed for this type shrink wrap application included bottom-sealed, side-gusseted bag structures, and even, as shown in FIG. 10A, a tube of thermoplastic, which is gathered and tied together to close one end thereof. In all of such prior art attempts, after heat shrinking of the film enshrouded pallet load, excess film material susceptible of snagging on objects and causing the film covering to be prematurely ripped from the pallet load it protectively encases, was present.

SUMMARY OF THE INVENTION

A shrink wrapped package and a method of producing such a package which comprises (a) drawing an open-mouth, flatbottom, thermoplastic bag into enveloping relationship with a substantially rectangular object, or rectangularly arranged group of objects, until the open-mouth of said bag surrounds the periphery of the base of said object; (b) subsequently heating said thermoplastic bag whereby said bag shrinks to snugly encase said rectangular object, the flat bottom and sides of said bag being in intimate contact with the top and sides, respectively, of said object.

BRIEF DESCRIPTION OF DRAWINGS

FIG. 2 is a continuous bottom gusseted and side-slit blank of lay flat-thermoplastic material used to form the square bottom side-seal bag.

FIG. 3 is a schematic view of the continuous blank, illustrated in FIG. 2, in a partially open condition.

FIG. 4 shows the individual bag blank with side-seals formed thereon, and severed from the continuous tube of FIG. 2.

FIG. 5 is a schematic view of the completed side-seal, bottom gusseted bag in lay-flat condition.

FIGS. 10A; 10B; and 10C are illustrations of prior art shrink wrapped pallet loads.

DESCRIPTION OF SPECIFIC EMBODIMENTS

It has been found, as hereinbefore discussed, that when employing a rectangular-bottom thermoplastic bag structure to shrink wrap a pallet load, it is desirable that the bag shrink to a greater extent in a direction which corresponds to the girth of the pallet than in the direction corresponding to the height of the pallet. Such controlled shrinkage insures that the pallet is tightly encased by the thermoplastic material around its perimeter or girth and also that the pallet is completely protected with the thermoplastic material throughout its entire height.

Applicants have found that bags which exhibit differential shrink properties when subjected to heat, i.e. having a higher shrink ratio in the direction which corresponds to the width of the bag and a comparatively lower shrink ratio in a direction which corresponds to the length of the bag, may be obtained by carefully controlling the extrusion conditions which are employed to produce the film stock material employed to fabricate such bags.

Film stock material with the desired properties as described above may be obtained utilizing conventional extrusion equipment to form a continuous tube of thermoplastic material such as polyethylene for example, utilizing a standard entrapped air-bubble extruder technique. In such a process polyethylene resin is introduced into the feed hopper of a rotating screw extruder wherein the resin pellets are heated, become molten, and the molten mass is forced through an annular die orifice at the exit end of the extruder to form a tube of semi-molten polyethylene film. Positioned at a distance from the annular die orifice are a pair of counter-rotating nip rollers which continuously draw the polyethylene tubing from the die orifice. Intermediate the orifice and the nip rollers, the semi-molten polyethylene tubing is allowed to cool and solidify, and simultaneously is internally blown to a diameter which exceeds the diameter of the annular orifice of the die. The amount of transverse direction orientation in the final film tubing, i.e. orientation in a direction which is substantially perpendicular to the machine direction of the tubing, is for the most intermediate determined by the blow-up ratio of the polyethylene tube intermediate the die orifice and the take-up rollers.

The amount of machine direction orientation which is imparted to the polyethylene tube is principally determined by the amount of machine direction draw imparted to the tube, which draw is determined by the difference in the rate of issuance of the molten polyethylene tube from the die orifice and the rate at which the tubing is taken up the take-up rollers, as the tubing begins to cool intermdiate the take-up rollers and the die.

Figure 1:
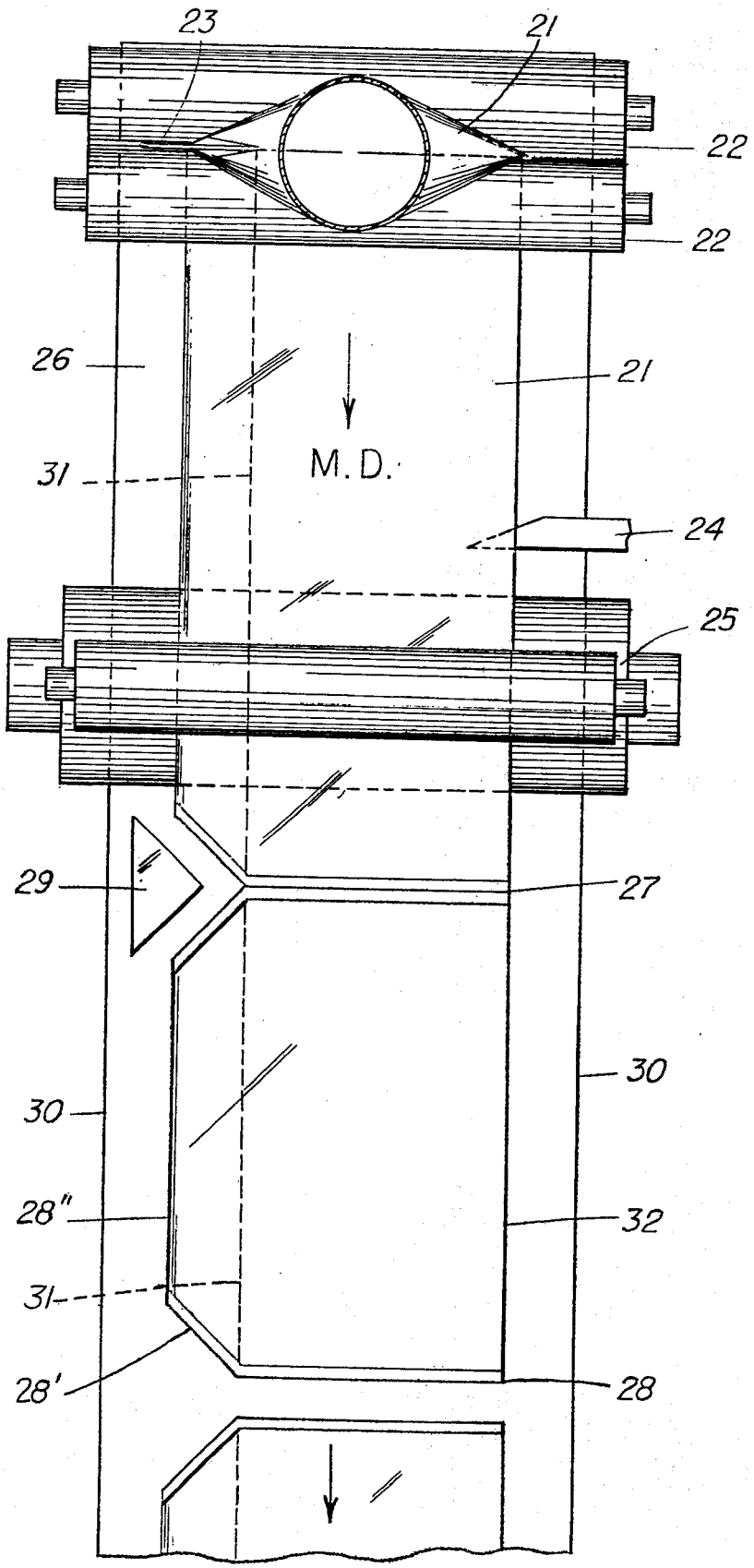
FIG. 1 is a schematic, overhead planar view of one form of an apparatus which may be employed in the present method.
Figure 6:
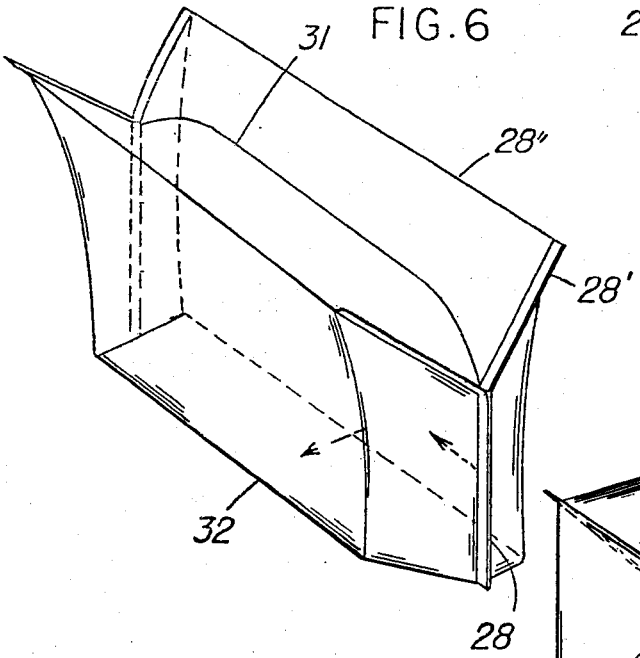
FIGS. 6 and 7 are schematic views of the bag, illustrated in FIG. 5, respectively, in a partially open and fully opened condition.

As illustrated in FIG. 1, which is a schematic overhead planar view of one form of apparatus which may be used to produce the bottom-gusseted, rectangular-bottom, side-seal bags of the present invention, a thermoplastic tube 21 such as polyethylene is extruded through the annular orifice of a die, affixed to the exit end of a standard rotating screw extruder (not shown). As tube 21 is inflated utilizing an entrapped air bubble, it is simultaneously drawn in the machine direction by nip rollers 22 which, in addition, serve to collapse the formed tube. As shown in FIG. 1, positioned adjacent nip rollers 22, is a gusset forming plate 23 which engages one longitudinal edge of the tubing forcing it interiorly of the tube so that upon emergence from nip rollers 22 the longitudinal edge of the tube, which was engaged by gusset plate 23, now has an inwardly extending pleat, i.e. gusset 26. The tubing 21 which is extruded in an upward vertical direction, after passage through nip rollers 22, is passed through another set on nip rollers 25 which change the direction of advancement of tube 21 to a generally horizontal plane.

Prior to entry of the gusseted tube 21 into the nip formed by rollers 25, the longitudinal edge of the tube, opposite the gusseted tube edge is continuously slit utilizing stationary slitter blade 24, as shown in FIG. 1. Upon emergence from nip rollers 25 the configuration of the tubing, having been treated as aforedescribed, is similar to that shown in FIG. 3 with the exception that, in FIG. 3, the gusseted and slit film material is in a partially open condition, for purposes of illustration.

Upon emergence from the nip formed by rollers 25, the slit and gusseted tubing is passed over the surface of a support member 30 whereon it is brought into contact with heat seal-cutoff element 27. Element 27 may be an electrically heated nichrome wire member (heating means not shown) the configuration of which resembles, as shown in FIG. 1, a Y. The stem of the Y portion of the element cuts and simultaneously forms a heat seal in that area which will correspond to the side of the finished bag. The diverging heat seal-cutoff portions of element 27, which engage the gusseted longitudinal edge of the film forms an angular cutoff and seal area in that are of the bag intermediate the side seal 28 and the folded portions of the bag bottom 28''. It will be noted that a substantial triangularly chip 29 of material, four layers thick, is cut away during this heat-seal-cutoff operation and may be treated as waste material or, conversely, recycled to the extruder. As the heat seal-cutoff element is raised out of contact with the advancing flattened tube 21, tube 21 continues to advance a distance which corresponds to the desired width of the bag, and the heat seal-cutoff element 27 is again recycled into contact with the flattened advancing web 21 whereby a bag identical in configuration to that illustrated in FIG. 5 is formed.

FIGS. 2 through 8 inclusive in the attached drawings schematically illustrate the structure of the bag as it is being formed in accordance with the forming process as illustrated in FIG. 1. As illustrated in FIG. 2, a continuous tube 21 which has a gusset fold 31 along one longitudinal edge thereof and which has been continuous slit along the opposite longitudinal edge 32 thereof is formed into a bag structure as illustrated in FIG. 4 by forming heat-seal seams 28, and contiguous, diagonal heat-seal seams 28' at opposite sides of the bag structure. As shown in FIG. 5, triangular portions 29, are cut away from the gusseted bottom portion of the bag structure whereby when the bag is in an open condition, progressively illustrated in FIGS. 6 and 7, a side-seal, rectangular bottom bag is formed.

Figure 9:
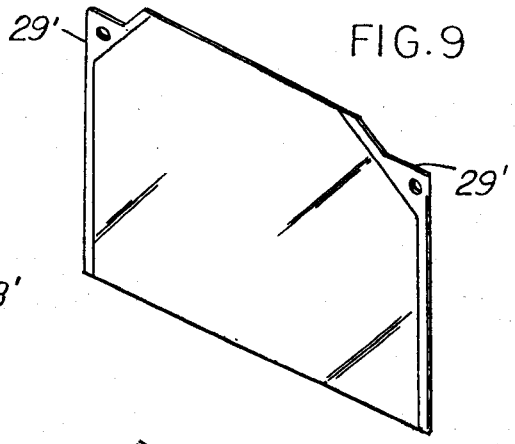
FIG. 9 is a schematic illustration of a modification of the bag illustrated in FIG. 5.
Figure 7:
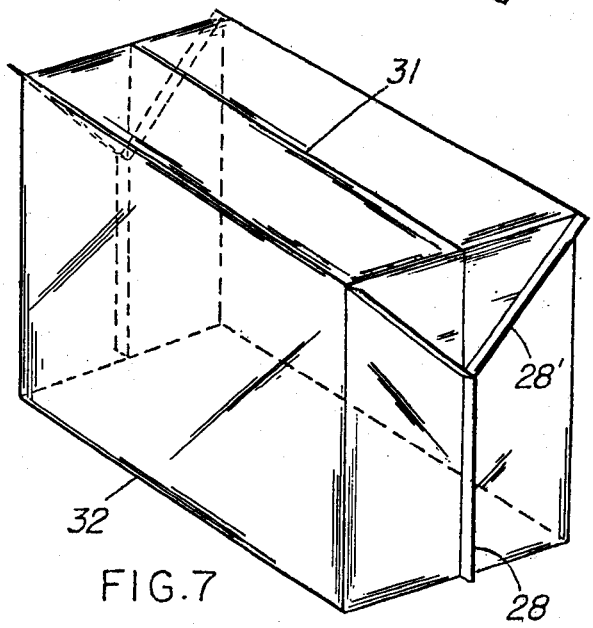

A modification of the bag structure illustrated in FIG. 5 is shown in FIG. 9 wherein, rather than completely cutting away triangular portions 29 on opposite ends of the bag bottom, a portion of triangular member 29 remains removably attached to seal line 28' along a perforated line. Such an arrangement allows for a plurality of bags to be suspended over pallet loads which are to be shrink-wrapped on for example a pair of spaced-apart rods which pass through the opening in triangular members 29'. Such an arrangement allows for removal of individual bags from an overhead suspended position by exerting a downward pull on the bag mouth 32 which frees the bag from the suspension rods by rupturing triangular members 29' along the perforations or lines on seal 28'. The bag now assumes the same structural configuration as the bag illustrated in FIG. 5, and it may be drawn directly down over the top of a pallet load to be shrink-wrapped.

Figure 11:
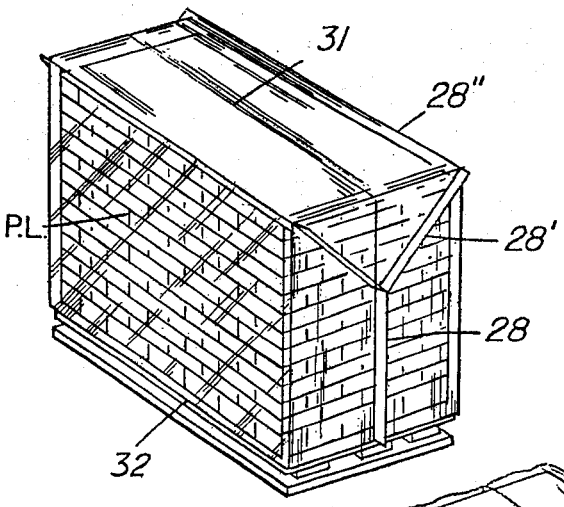
FIG. 11 is an illustration of the bag shown in FIG. 5 after being heat-shrunk about a pallet load.
Figure 11A:
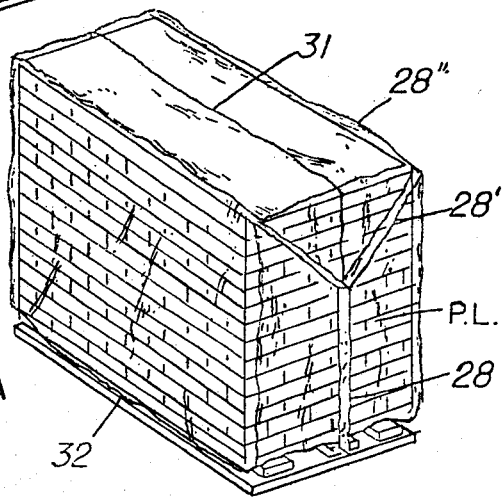
FIG. 11A schematically illustrates the bag of FIG. 5 after it has been placed over a pallet load and prior to heat shrinkage.
Figure 8:
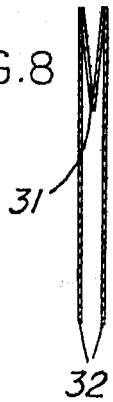
FIG. 8 is a cross-sectional view taken on line 8—8 of FIG. 5.

In FIG. 11, a bag structure of the present invention has been placed over a substantially rectangular pallet load. It will be noted, as shown in FIG. 11a, that prior to exposure of the thermoplastic structure to heat, the bag fits rather loosely and does not tightly encase the load being overwrapped. However, as shown in FIG. 11, after exposure of the bag enshrouded pallet assembly to heat, for example by passing it through a heat-tunnel, the film shrinks to tightly and uniformly encase the pallet load. Since the film, as hereinbefore described, has a relatively high degree of orientation in the machine direction as it is being extruded, that is to say a high degree of orientation in a direction which corresponds to the width of the finished bag structure, when heat is applied, the bag will shrink to a greater extent around the girth of the pallet load thereby tightly encasing the load in the overwrapped film. Shrinkage of the film in the transverse direction; that is to say, in the direction which corresponds to the length of the bag after it has been formed, is somewhat less than shrinkage of the bag around the girth. This is especially desirable, since it reduces the tendency for the bottom, or mouth 32, of the bag to shrink up towards the top of the pallet load which would result in the bottom portion of the pallet load being exposed. Moreover, it has been found that there is a tendency for the mouth 32 to shrink and curl up around the bottom of the pallet load to thereby seal the load completely around its base to further insure protective encasement for the entire load being shrink-wrapped.

The following example illustrates a specific method which may be employed to produce the side-seal, bottom-gusseted bag structures employed in the present invention and is used merely for purposes of illustration and, accordingly, should not be construed in a limiting sense.

EXAMPLE 1

Polyethylene resin pellets, identified by the manufacturer as MO-34 are fed into the hopper of a standard rotating screw extruder having a L/D ratio of 25:1. Molten polyethylene is extruded from the extruder through an annular die orifice having an orifice gap of about .025 mils and a diameter of about 65 inches, at a melt temperature of about 370° F. As the polyethylene tubing is being extruded from the die orifice, and prior to entry into the nip rollers 22, it is cooled utilizing standard external air-cooling rings which are positioned around the circumference of the tubing and out of contact therewith. The blow-up ratio of the tubing intermediate the annular die and the nip rollers 22 is about 1.37:1. The draw-down ratio of the tubing in the machine direction is about 1:1. Prior to entry of the tube into nip rollers 22, one longitudinal edge thereof is gusseted utilizing gusset plate member 23 as illustrated in FIG. 1. The width of the gusseted lay-flat tube is approximately 77 inches. Upon emergence from the nip rollers 22 the gusseted tubing is slit utilizing blade member 24 and passed through nip rollers 25. Heated nicrome wire 27, substantially in the shape of a Y is brought into contact with the advancing tube 21 as illustrated in FIG. 1 to cut the tube and to form the side-seal 28 and 28' and to simultaneously cut away triangular chip member 29. As the member 27 is raised out of contact with the tube, the tube is allowed to advance for a predetermined length whereupon member 27 is again brought into contact with the tubing to complete formation of the bag. The bag width along the open-mouth portion 32 was approximately 92 inches. The width of the bottom folds 28'', intermediate the diagonal seals 28', was about 50 inches.

The formed bag was than placed over a substantially rectangular pallet load having dimensions of about 40 × 48 × 50''. The enshrouded pallet load was subsequently passed through a radiantly heated shrink tunnel wherein it was exposed to a temperature of about 400° F for a period of about 45 seconds. Upon emergence from the heat-shrink tunnel the thermoplastic material tightly encased the pallet load around the girth thereof and the rectangular top portion of the pallet load edge was in uniform contact with the rectangular bag bottom and the entire pallet load had a very neat, smooth appearance by virtue of the uniform conformation of the shrunken bag structure thereto.

Although the present invention has been described with preferred embodiments, it is to be understood that modifications and variations may be resorted to, without departing from the spirit and scope of this invention, as those skilled in the art will readily understand. Such variations and modifications are considered to be within the purview and scope of the appended claims.

What is claimed is:

1. A method of wrapping a pallet load comprising forming a biaxially oriented shrinkable, thermoplastic film, and providing a greater degree of orientation and therefore a greater shrinkability in a first direction than in a second direction, from said film forming a plastic bag having front and rear walls joined to each other along a pair of opposite edges to define an internal bag enclosure having an open mouth, a continuous square bottom containing a gusset and tabs removably attached to and extending from the joined opposite edges directed toward said gussetted bottom, said bag being formed with said open mouth substantially parallel to said first direction of said film; suspending a plurality of said bags from said tabs in a mouth downward orientation; disposing a loaded pallet below and in substantial vertical alignment with said bags; downwardly propelling a bag with sufficient force to disengage such from said tabs and overwrapping said pallet and load therewith; and heating said overwrapped pallet load sufficient to shrink said bag thereabout, said shrunk bag exerting greater force on said load in a direction substantially parallel to said mouth than in a direction substantially perpendicular to said mouth.

2. A method as claimed in claim 1 wherein said tabs have holes therein the axes of which are substantially perpendicular to said front and rear walls; and including suspending said bags by insertion of a rod through each corresponding hole of said plurality of bags.

* * * * *